US008950115B2

(12) United States Patent
Andersson et al.

(10) Patent No.: US 8,950,115 B2
(45) Date of Patent: Feb. 10, 2015

(54) MECHANISM FOR MOVING A DOOR FROM A FIRST LOCATION TO A SECOND LOCATION

(75) Inventors: Benny Andersson, Almhult (SE); Hakan Persson, Malmo (SE)

(73) Assignee: Inter IKEA Systems B.V. (NL)

( * ) Notice: Subject to any disclaimer, the term of this patent is extended or adjusted under 35 U.S.C. 154(b) by 0 days.

(21) Appl. No.: 13/983,465

(22) PCT Filed: Feb. 10, 2012

(86) PCT No.: PCT/EP2012/052258

§ 371 (c)(1),
(2), (4) Date: Oct. 15, 2013

(87) PCT Pub. No.: WO2012/110405

PCT Pub. Date: Aug. 23, 2012

(65) Prior Publication Data

US 2014/0026488 A1 Jan. 30, 2014

(30) Foreign Application Priority Data

Feb. 16, 2011 (DE) ..... 20 2011 002 810 U

(51) Int. Cl.
*E05D 15/10* (2006.01)

(52) U.S. Cl.
CPC ..... *E05D 15/10* (2013.01); *E05D 15/1065* (2013.01); *E05D 2015/1076* (2013.01);
(Continued)

(58) Field of Classification Search
USPC ..... 49/209, 211, 212, 214, 216, 218, 219, 49/221, 210, 246, 248, 249, 250, 254, 152, 49/153, 252, 103; 312/322, 325, 329
See application file for complete search history.

(56) References Cited

U.S. PATENT DOCUMENTS 2,170,098 A * 8/1939 Stephenson ..... 108/136
2,299,317 A * 10/1942 Fink ..... 49/249

(Continued)

FOREIGN PATENT DOCUMENTS

CH 492 859 6/1970
DE 3101000 A1 * 12/1981 ..... E05D 13/02

(Continued)

OTHER PUBLICATIONS

International Search Report for International Application No. PCT/EP2012/052258 mailed May 4, 2012 (2 pages).

*Primary Examiner* — Katherine Mitchell
*Assistant Examiner* — Marcus Menezes
(74) *Attorney, Agent, or Firm* — Merchant & Gould P.C.

(57) ABSTRACT

A method and mechanism for moving an element, such as a sliding door (1), is disclosed. In the movement a first end of the element is first turned outwards, a second opposite end is then turned out placing the element in parallel with the original location of the element. The element is then displaced by extending a pull-out guide (4). The mechanism comprises a housing (2), the pull-out guide rail (4), a lock-and-release mechanism (19) and at least two lever arms (8, 11, 14, 16, 27, 30, 33, 39, 42). One end of a first lever arm (8, 27, 39) is received in a pivoting point (10, 29, 41) at the pull-out guide rail (4) and the opposite end of said lever arm (8, 27, 39) is received in a pivoting point (9, 28, 40) at the housing (2). The pivoting point (10, 29, 41) at the pull-out guide rail (4) is placed at a first end of the pull-out guide rail (4).

2 Claims, 13 Drawing Sheets

(52) U.S. Cl.
CPC ... *E05D2015/1097* (2013.01); *E05Y 2800/266* (2013.01); *E05Y 2800/296* (2013.01); *E05Y 2900/20* (2013.01)
USPC ..... 49/212; 49/209; 49/211; 49/214; 49/246; 49/248; 49/249; 49/250; 49/254; 312/322; 312/325; 312/329

(56) References Cited

U.S. PATENT DOCUMENTS

| | | | | | |
|---|---|---|---|---|---|
| 2,439,494 | A | * | 4/1948 | Stone | 16/288 |
| 3,484,993 | A | * | 12/1969 | Gerhard et al. | 49/216 |
| 3,859,753 | A | * | 1/1975 | Marcuzzi | 49/103 |
| 4,337,596 | A | * | 7/1982 | Kern et al. | 49/210 |
| 4,495,729 | A | * | 1/1985 | Britzke et al. | 49/212 |
| 4,617,756 | A | * | 10/1986 | Dilcher | 49/212 |
| 4,924,625 | A | * | 5/1990 | Dilcher | 49/212 |
| 5,253,452 | A | * | 10/1993 | Goldbach | 49/212 |
| 7,765,740 | B2 | * | 8/2010 | Heuel et al. | 49/360 |
| 8,122,644 | B2 | * | 2/2012 | Jarolim | 49/209 |
| 8,276,316 | B2 | * | 10/2012 | Takeda et al. | 49/221 |
| 8,469,441 | B2 | * | 6/2013 | Heuel et al. | 296/155 |
| 2006/0225357 | A1 | * | 10/2006 | Bortoluzzi | 49/213 |

FOREIGN PATENT DOCUMENTS

| | | |
|---|---|---|
| DE | 37 28 998 | 3/1989 |
| DE | 200 06 997 | 6/2000 |
| EP | 0 359 640 | 3/1990 |

* cited by examiner

MECHANISM FOR MOVING A DOOR FROM A FIRST LOCATION TO A SECOND LOCATION

This application is a National Stage Application of PCT/EP2012/052258, filed 10 Feb. 2012, which claims benefit of Serial No. 20 2011 002 810.0, filed 16 Feb. 2011 in Germany and which applications are incorporated herein by reference. To the extent appropriate, a claim of priority is made to each of the above disclosed applications.

TECHNICAL FIELD

The present invention generally relates to a method of moving an element from a first location to a second location, which movement includes a sliding movement. The invention also relates to a mechanism for performing the method of moving the element.

BACKGROUND

The element to be moved may be any kind of element to be moved from an opening between adjacent elements or in a frame etc, such as walls, to a location displaced from the opening, whereby the element is to be slid to a position in parallel with the adjacent elements etc. in a last part of the movement. The element can be a door of different kinds of furniture, parts of buildings, hatches, such as roof hatches, etc.

One problem for this kind of movement is to get a smooth moving operation, as the element first has to be moved free of an adjacent element, before a sliding movement is performed.

For example sliding doors for furniture, e.g. cabinets, lockers, etc., normally implies disadvantages in sense of design options, space needed, and ability to access items in the furniture. It is therefore a desire to provide an improved method of opening and closing for instance a sliding door for cabinets. It is also a desire to provide a mechanism giving for instance sliding doors a desired movement.

SUMMARY

An object of the invention is to at least alleviate the above stated problem. The present invention is based on the understanding that provision of proper linkage mechanism together with a pull-out guide rail can give a flush appearance when for instance a sliding door of a cabinet is closed and a neat movement towards the open state and opposite towards the closed state.

One important part of the present invention is that a smooth movement, including a sliding movement, can be accomplished by first forcing one end of an element placed in between adjacent elements to be turned outwards. There after the opposite end of the element is turned outwards, whereby the element will be in a location parallel with the location in the opening. In said parallel location, but not before reaching it, the element is allowed to make a sliding movement.

In the detailed description below the element is a sliding door, but a person skilled in the art realises that the invention may be used for many different types of elements, as indicated above. Even though sliding doors often are made of some kind of wooden product, a person skilled in the art realizes that the present invention may be utilized for elements of any material.

According to a first aspect, there is provided a method of moving an element from a first location, inside an opening, to a second location, outside and displaced from the opening.

The movement includes a sliding movement and the total movement has a number of separate steps. In a first step one end of the element is turned outwards to a first end position. In a second step the other end of the element is turned outwards until the element is in a location parallel to the original location. At the end of said second step a locking means is released. In a third step the element is slid into the second location by extending a pull-out guide rail, in which the element is received. The above steps of the movement are repeated in reversed order to move the element from the second location to the first location inside the opening.

According to a second aspect, there is provided a mechanism for performing the above movement. The mechanism has a housing. It also has a pull-out guide rail, having a first member thereof mounted to an element to be moved. The first member and a second member are slidably arranged with each other. The mechanism further comprises at least two lever arms. One end of a first lever arm is received in a pivoting point at the pull-out guide rail and the opposite end of said lever arm being received in a pivoting point at the housing of the mechanism. The pivoting point at the pull-out guide rail is placed at a first end of the pull-out guide rail.

For an element to be moved there is normally one mechanism at two opposing ends of the element.

The pull-out guide rail may have a third member slidably arranged between the first member and the second member for increasing the slidable range of the pull-out guide rail.

The mechanism may further comprise a lock-and-release mechanism arranged to lock mutual displacement between the first member and the second member of the pull-out guide rail when in a first location, and arranged to release the lock when in a second location.

Other objectives, features and advantages of the present invention will appear from the following detailed disclosure, from the attached dependent claims as well as from the drawings. Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of different embodiments of the present invention, with reference to the appended drawings.

DETAILED DESCRIPTION OF EMBODIMENTS

Figure 1:
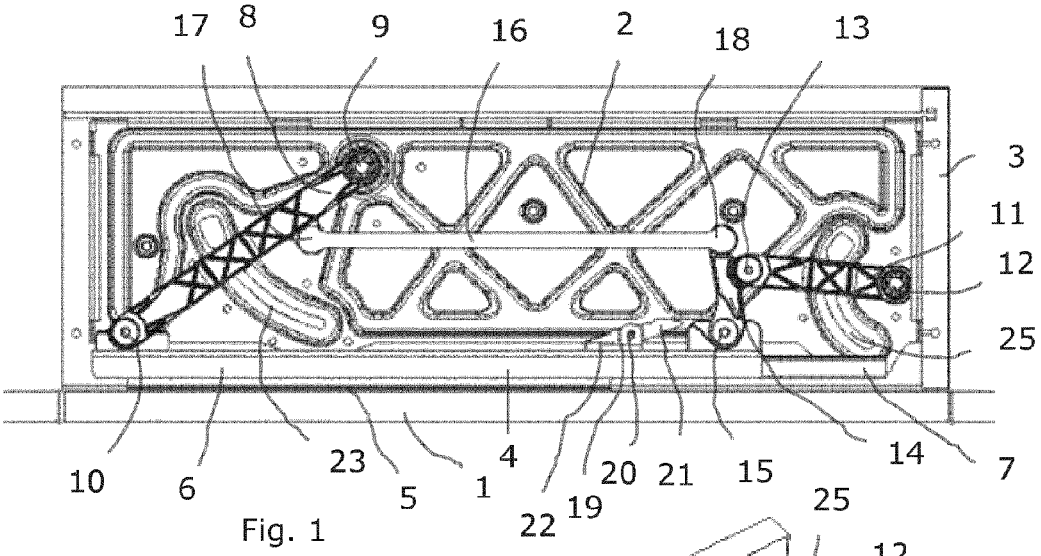
FIG. 1 illustrates a first embodiment of a mechanism for an element in the form of a sliding door.

FIG. 1 illustrates a mechanism for a sliding door 1 according to a first embodiment. The mechanism comprises a housing 2 arranged to be mounted on a frame 3 of a furniture having the door 1. The furniture can for example be a closet, cabinet, locker, bookshelf with door, etc. The frame 3 can be made of wood, polymer, board material, metal, etc. and comprise sidepieces, a top piece, a bottom piece and preferably also a back piece. Together with the door 1, the frame 3 preferably defines a space for storing clothes, gear, books, etc. Preferably, the housing 2 of the mechanism is mounted on the top piece of the frame, and an additional similar mechanism may be mounted on the bottom piece such that the door can be given a stabile mounting and movement pattern, which will be understood from the description below.

The mechanism further comprises a pull-out guide rail 4. The pull-out guide rail 4 comprises a first member 5 and a second member 6 which are mutually slidable to implement the pull-out function. Such pull-out guide rails are known in the art of drawers as for example disclosed in European patent application with publication No. 2114206. As also indicated in this European patent application, the pull-out guide rail can have a third member 7 slidably arranged between the first member 5 and the second member 6 for increasing the slidable range of the pull-out guide rail 4. The pull-out guide rail 4 being of the so called full expansion type enables the door to be fully out of way for access to items in the furniture. Further, as also disclosed in this European patent application, the sliding can be enhanced by balls or rollers for reduction of friction between the members. The pull-out guide rail can also be provided with damping elements for damping the sliding movement at its extreme points.

The first member 5 of the pull-out guide rail 4 is mounted to the door 1, while the second member 6 is mounted to lever arms of the mechanism, as will be described below.

The pull-out guide rail 4 gives the advantage that the guide rail can be hidden behind the door, i.e. concealed to the user, when the door is closed, which enables improved design options.

In the following description, lever arms and pivoting points, respectively, are assigned identification as first, second, etc. to enable distinguishing the lever arms and pivoting points, respectively, from each other. The identification should not be construed to define any difference timing or importance.

Figure 2:
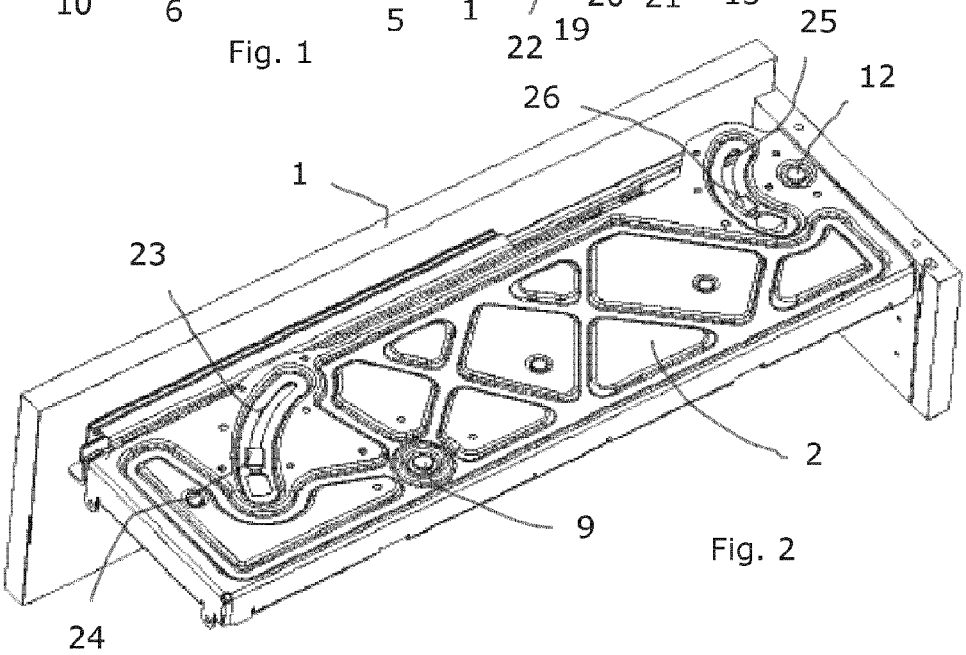
FIG. 2 illustrates the mechanism of FIG. 1 from another view.
Figure 3:
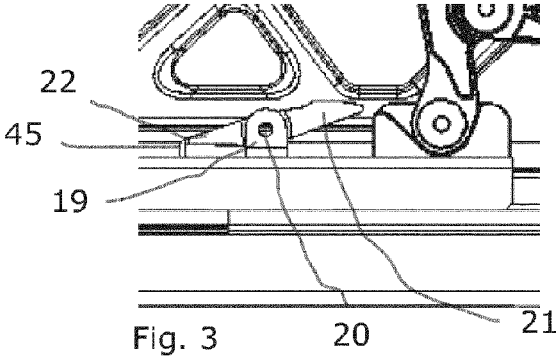
FIG. 3 illustrates an enlarged view of the mechanism of FIG. 1 with a first embodiment of a lock-and-release mechanism.
Figure 4:
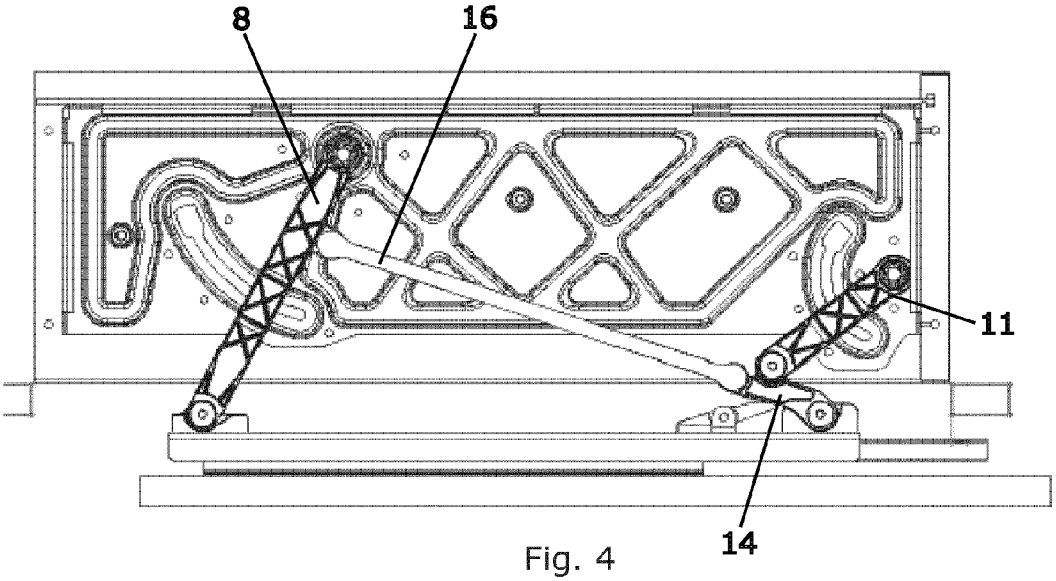
FIG. 4 illustrates the mechanism of FIG. 1 when in another position.

The mechanism further comprises a first lever arm 8 pivotally arranged between a first pivoting point 9 of the housing 2 and a second pivoting point 10 of the second member 6 of the pull-out guide rail 4. The mechanism further comprises a second lever arm 11 pivotally arranged between a third pivoting point 12 of the housing and a fourth pivoting point 13 of a third lever arm 14 which is pivotally arranged to a fifth pivoting point 15 of the second member 6 of the pull-out guide rail 4. The mechanism further comprises a fourth lever arm 16 pivotally arranged between a sixth pivoting point 17 of the first lever arm 8 and a seventh pivoting point 18 of the third lever arm 14. The arrangements of the housing 2, the lever arms 8, 11, 14, 16 and the second member 6 can be seen to form a sort of semi-parallelogram, where the parallel properties only applies to a first position, i.e. as illustrated in FIGS. 1 to 3, and a second position, i.e. as illustrated in FIG. 4, while there between, the second member 6 displaces in a non-parallel way, as will be described below with reference to FIGS. 5 to 8.

In the first position or location, where the door 1 is closed, the general direction of the second lever arm 11 is approximately parallel to a general direction of the pull-out guide rail 4. The "approximately parallel direction" to the general direction of the pull-out guide rail 4 of the general direction of the second lever arm 11 is an angle between 5 degrees and 15 degrees to the general direction of the pull-out guide rail 4, where positive angle means that the third pivoting point 12 is closer to the pull-out guide rail 4 than the fourth pivoting point 13. Preferably, the angle is between 0 degrees and 10 degrees, most preferably about 5 degrees. The approximately parallel direction gives the advantage that the edge of the door is enabled to move out without interfering with a close-by item, e.g. a neighbouring door mounted in the same plane as the sliding door, which enables improved design options. Here, the third lever arm 14 is essentially perpendicular to the pull-out guide rail 4 to push out the door from the close-by item upon the movement, which will be demonstrated in greater detail below, towards the second position or location. The angle provides that the critical end of the door, i.e. the one to displace first when moving from the first to the second position, turns out without interfering with a neighbouring door or item. This is given by the fourth pivoting point 13 moving essentially perpendicular to the general direction of the pull-out guide rail during the first part of the movement from the first position towards the second position.

In the second position, the pull-out guide rail 4 is parallel displaced compared to when in the first position by pivoting the second lever arm 11 around the third pivoting point 12 such that the first, third and fourth lever arms 8, 14, 16 ensures the pull-out guide rail 4 to be essentially parallel displaced compared to when in the first position, and the door 1 can be slid into an open position by extending the pull-out guide rail 4. The parallel displacement places the door 1 in a position where it can be opened by the pull-out guide rail without interfering with a close-by item, e.g. a neighbouring door mounted in the same plane as the sliding door, which enables improved design options.

The arrangement of pivot axes makes the mechanism move straight between the first and second positions, i.e. the door is kept in the same altitude during the movement although moving according to the preferred pattern in the other two directions. For enabling this, all axes of pivoting of the first to seventh pivoting points 9, 10, 12, 13, 15, 17, 18 are mutually essentially parallel and perpendicular to the general direction of the pull-out guide rail 4 and perpendicular to a direction of the parallel displacement between the first position and the second position.

The sliding movement is desired only when the mechanism is in its second position. Therefore, the mechanism can further comprise a lock-and-release mechanism 19 arranged to lock mutual displacement between the first member 5 and the second member 6 of the pull-out guide rail 4 when in the first position, and arranged to release the lock when in the second position. The lock-and-release mechanism keeps the door in place until the slide-open action is to be made. In addition to easier handling and an increased quality feeling, the feature also prevents neighbouring doors or other items mounted in the same plane as the closed door to be exposed to wear or damage by the sliding of the door to be opened. The lock-and-release mechanism 19, which also is illustrated in magnification in FIG. 3, can comprise a two-armed lever, pivotably arranged around an eighth pivoting point 20 of the second member 6 of the pull-out guide rail 4. A spring acts on the lever urging it towards the position as shown in FIG. 3. A first arm 21 of the two-armed lever is arranged to abut the third lever arm 14 when in the second position such that a second arm 22 of the two-armed lever disengages the lock upon the two-armed lever pivoting around the eighth pivoting point 20, by the second arm 22 being lifted free of a pin 45 on the pull-out guide rail 4. This configuration of the lock-and-release mechanism combines a non-complex and automatically working mechanism.

The mechanism can be configured such that on the third lever arm 14, the fourth pivoting point 13 is arranged between the fifth pivoting point 15 and the seventh pivoting point 18 considered in a general direction of the third lever arm 14. Further, the configuration can be such that on the first lever arm 8, the sixth pivoting point 17 is arranged between the first pivoting point 9 and the second pivoting point 10 considered in a general direction of the first lever arm 8. The configuration of the pivoting points provides a particularly suitable movement of the door and pull-out guide rail from the first to the second positions and back.

The load on a lever arm can be considerable, depending on the weight of the door, and especially when in the second position and the pull-out guide rail in its extended position. If the entire load is to be taken at the pivoting point at the housing, the dimensions for this pivot would in case of a heavy door need to be considerable. In the light of a versatile mechanism for different sizes and materials of the door, the mechanism would not be economically viable for most of its applications. An approach for solving this has been found by providing a support at a distance from the pivot. The housing 2 can for example comprise an arc-formed slot forming an arc with a constant radius to the pivoting point, and the lever arm can comprises a guiding knob for enabling taking up force both towards and away from the housing 2 to and from the lever arm, arranged to engage with the arc-formed slot. In addition to enabling a more economical dimension of the pivot, this solution enables to limit displacement in a direction parallel to a pivoting axis of the pivoting point. Such an arrangement can be provided either to the first lever arm or to the second lever arm, or to both. With reference to the discussion above when the door is slid out, the application of a knob approach on the second lever arm is particularly advantageous when the mechanism is provided on an top piece of the frame of the furniture, and the application of a knob approach on the first lever arm is particularly advantageous when the mechanism is provided on an bottom piece of the frame of the furniture.

Thus, the housing 2 can further comprise a first arc-formed slot 23 forming an arc with a constant radius to the first pivoting point 9, and the first lever arm 8 comprises a first guiding knob 24 arranged to engage with the first arc-formed slot 23 to limit displacement in a direction parallel to a pivoting axis of the first pivoting point 9, and/or the housing 2 further comprises a second arc-formed slot 25 forming an arc with a constant radius to the third pivoting point 12, and the second lever arm 11 comprises a second guiding knob 26 arranged to engage with the second arc-formed slot 25 to limit displacement in a direction parallel to a pivoting axis of the third pivoting point 12, as can be seen in FIGS. 2 and 4 for the respective first and second positions. The slots and knobs strengthen the construction and prevent the door from unintentional change in altitude or twisting as the load from the door changes during displacement.

An alternative to a slot approach is to have a support surface with similar geometrics as the arc-formed slot, i.e. to provide a support at a distance from the pivot. The support surface is thus only enabled to take up a force between the surface and the lever arm. However, if a mechanism is provided at both top piece and bottom piece of the frame of the furniture, and the support surface is provided both for the first and second lever arms 8, 11, this solution will provide similar advantages as the knob approach.

Figure 5:
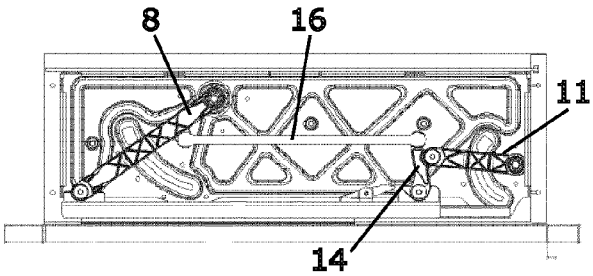
FIGS. 5 to 10 illustrate in sequence an opening motion for the first embodiment of the mechanism, where the door is closed in FIG. 5 and fully open in FIG. 10.
Figure 6:
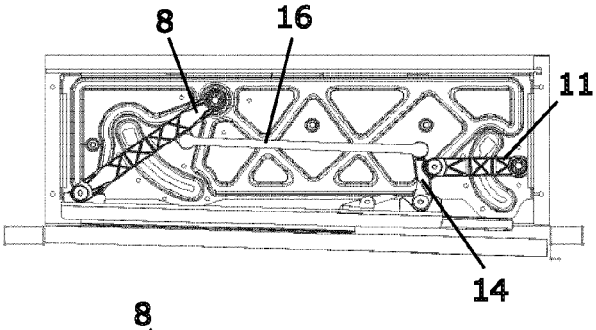
Figure 7:
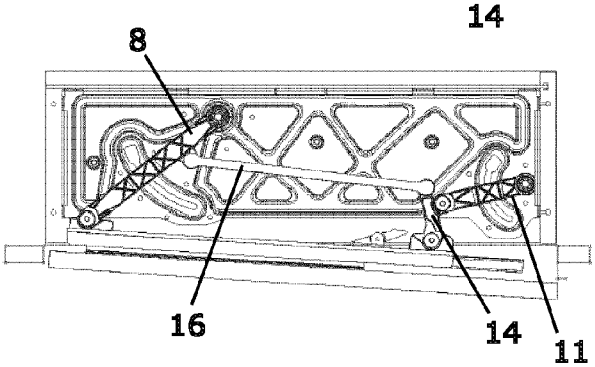
Figure 8:
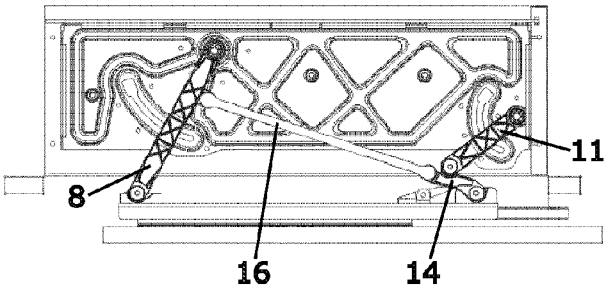
Figure 9:
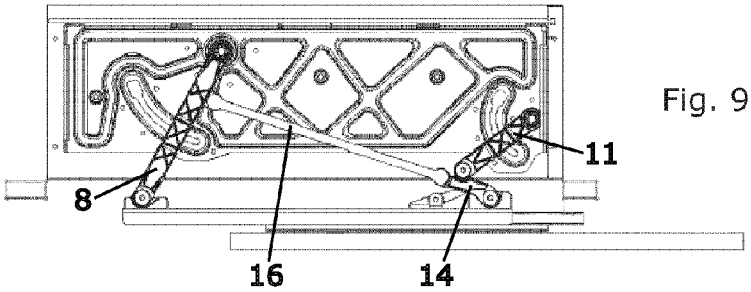
Figure 10:
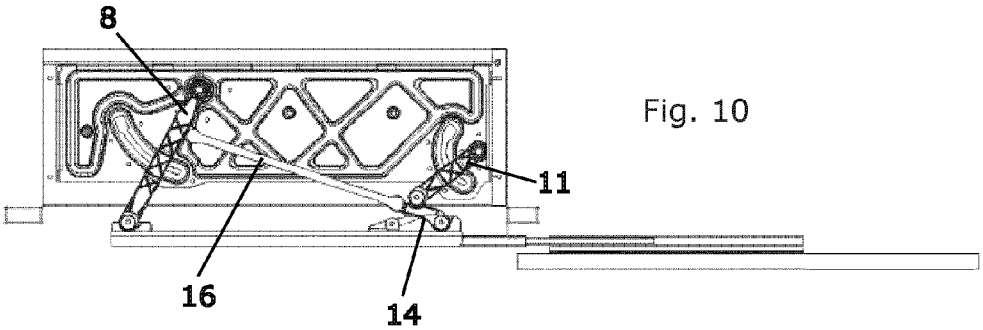
Figure 11:
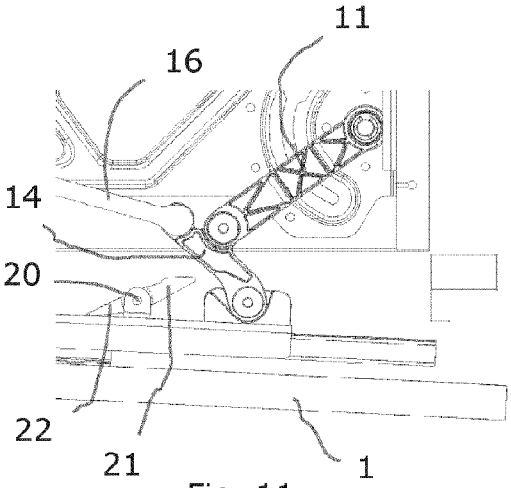
FIGS. 11 to 14 illustrate in sequence the lock-and-release mechanism of FIG. 3 in the opening sequence.
Figure 12:
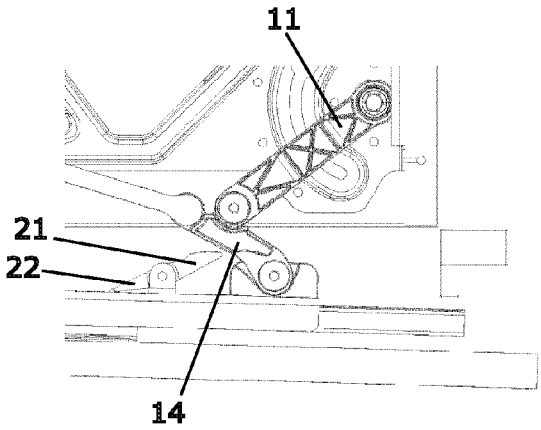
Figure 13:
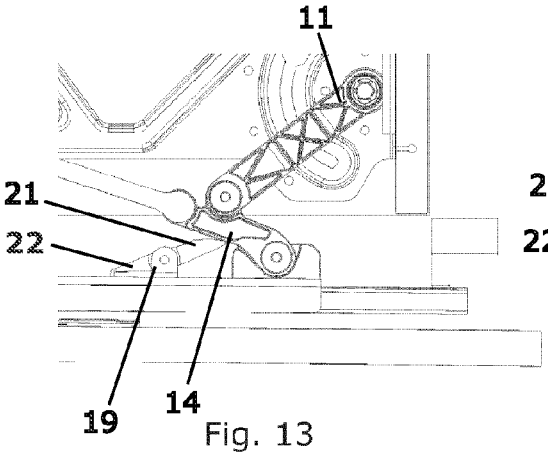
Figure 14:
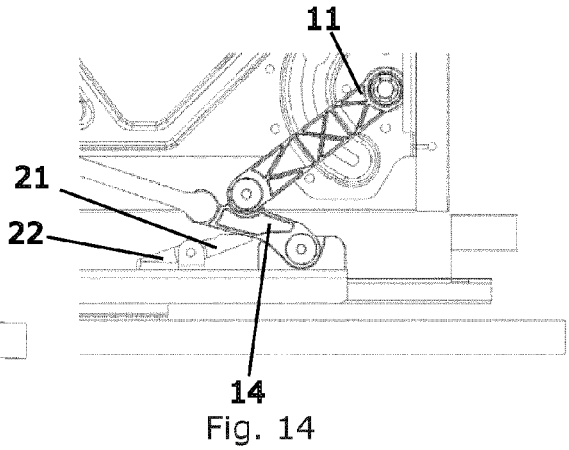

FIGS. 5 to 10 illustrate in sequence the opening motion, where the door is closed in FIG. 5 and fully open in FIG. 10. The closing motion follows the opposite way, i.e. in sequence from FIG. 10 to FIG. 5. FIGS. 11 to 14 illustrate in sequence the optional lock-and-release mechanism 19 in the opening sequence, where FIG. 14 illustrates the lock-and-release mechanism 19 being in its release position such that the door can be slid to its open state, as illustrated in FIG. 10. As shown during the opening motion the third lever arm 14 will make contact with the first arm 21 of the two-armed lever and press the arm 21 downwards. By the movement of the first arm 21 the two-armed lever will turn in the eight pivoting point 20 lifting the second arm 22 of the two-armed lever. When the second arm 22 has been lifted free of the pin 45, the door 1 may be slid open. The two-armed lever is pre-tensioned by means of a spring to a position where the second arm 22 abuts a member of the pull-out guide rail 4. Thus, when releasing the lock-and-release mechanism the movement of the third lever arm 14 has to overcome the force of the spring.

Figure 15:
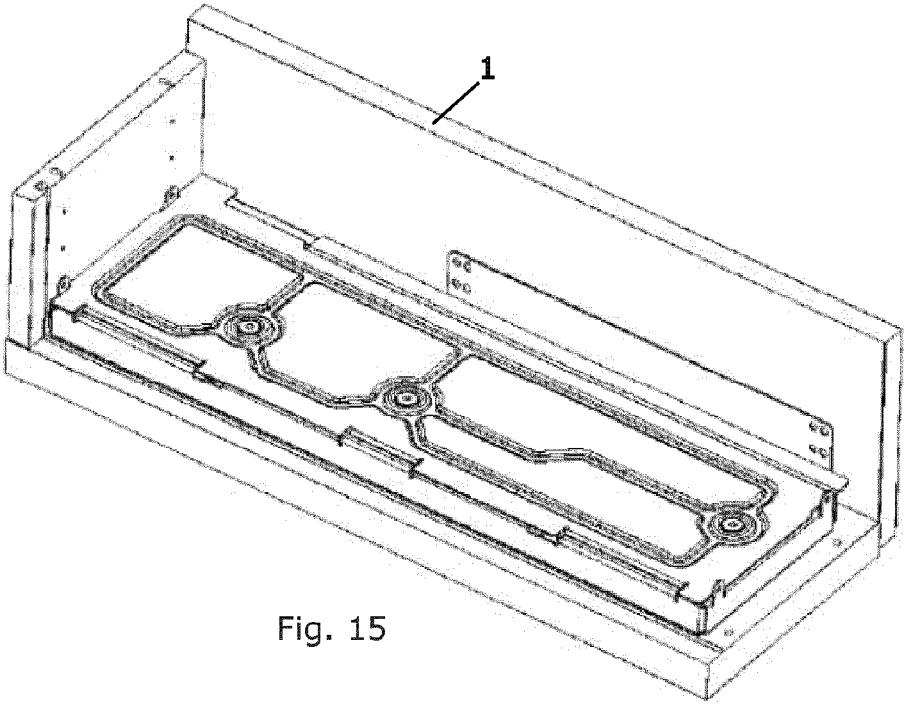
FIG. 15 illustrates in perspective view of the mechanism mounted to a furniture frame and door, respectively, and with a cover plate mounted over the mechanism.
Figure 16:
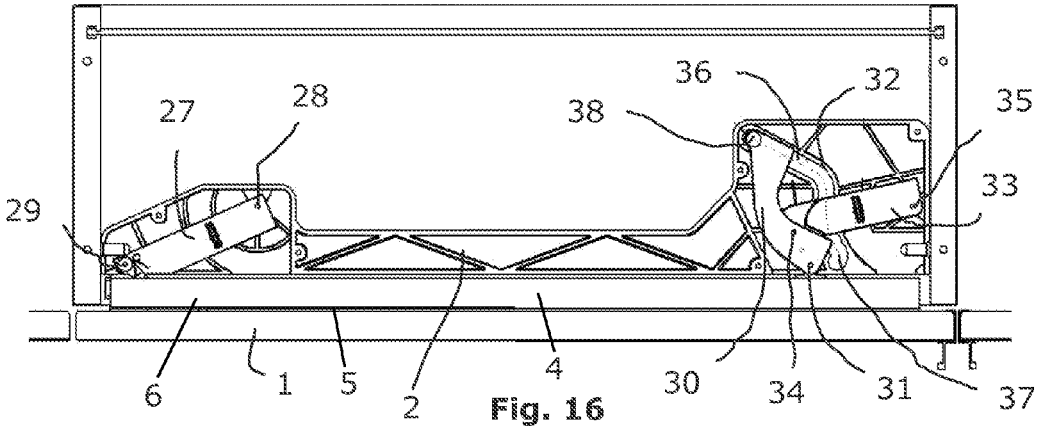
FIGS. 16 to 20 illustrate in sequence an opening motion for a second embodiment of a mechanism for a sliding door.
Figure 17:
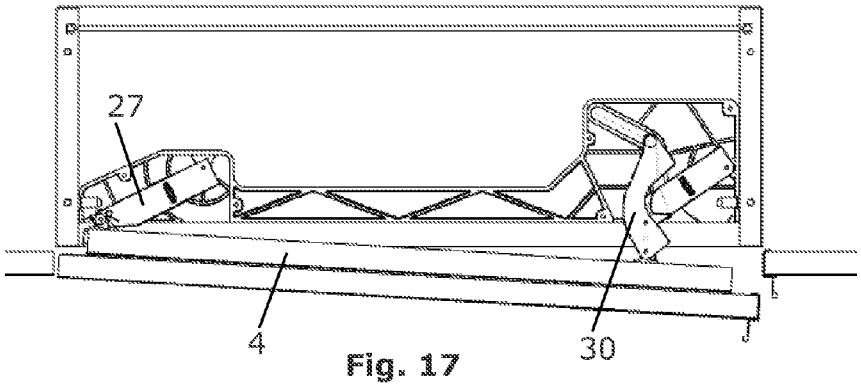
Figure 18:
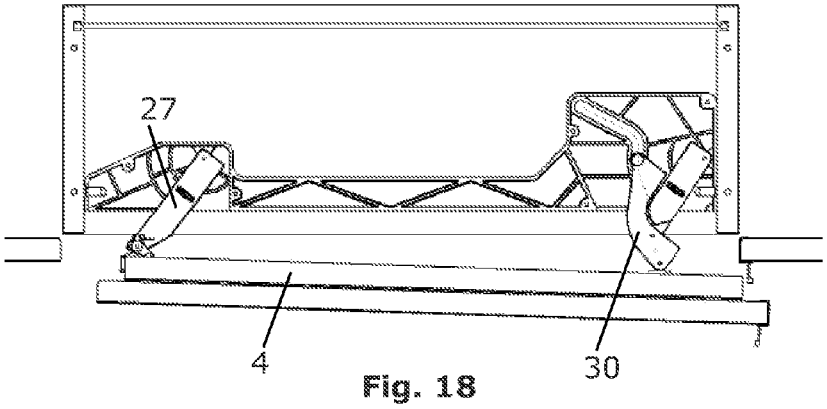
Figure 19:
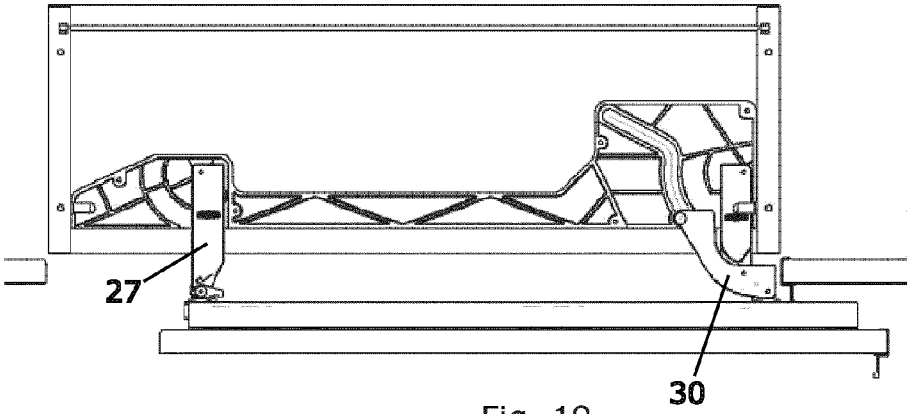
Figure 20:
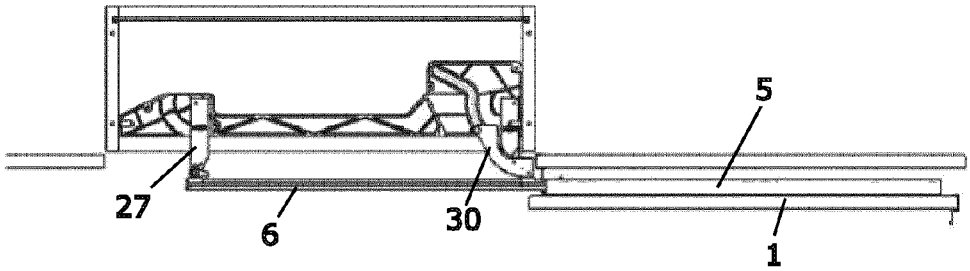
Figure 21:
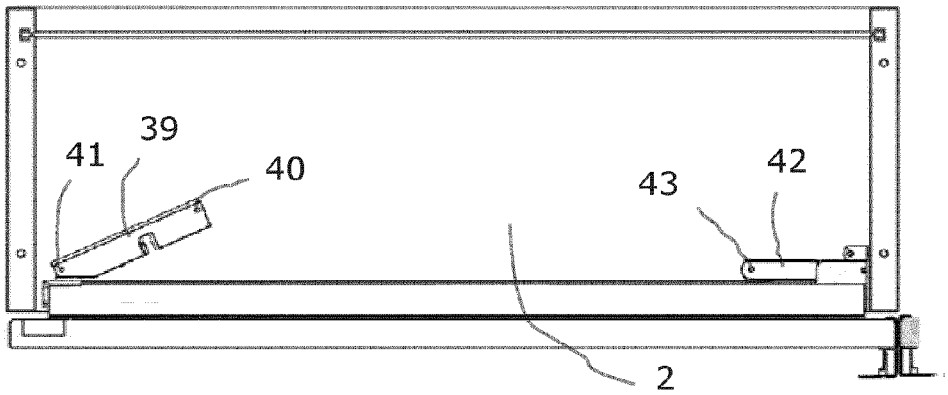
FIGS. 21 to 24 illustrate in sequence an opening motion for a third embodiment of a mechanism for a sliding door.
Figure 22:
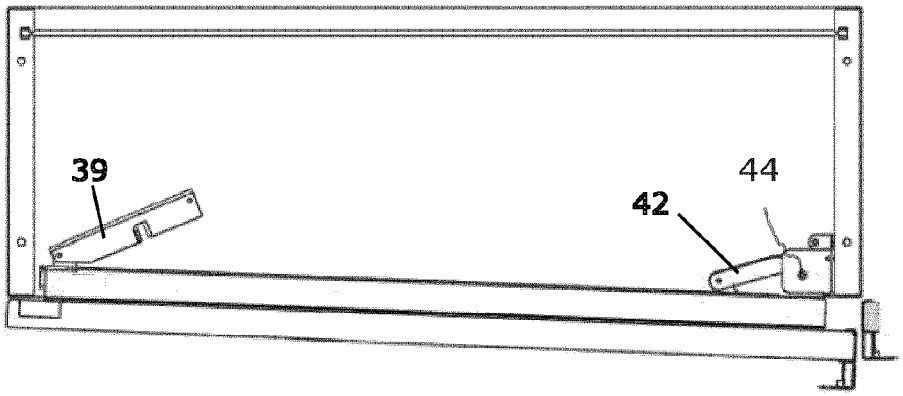
Figure 23:
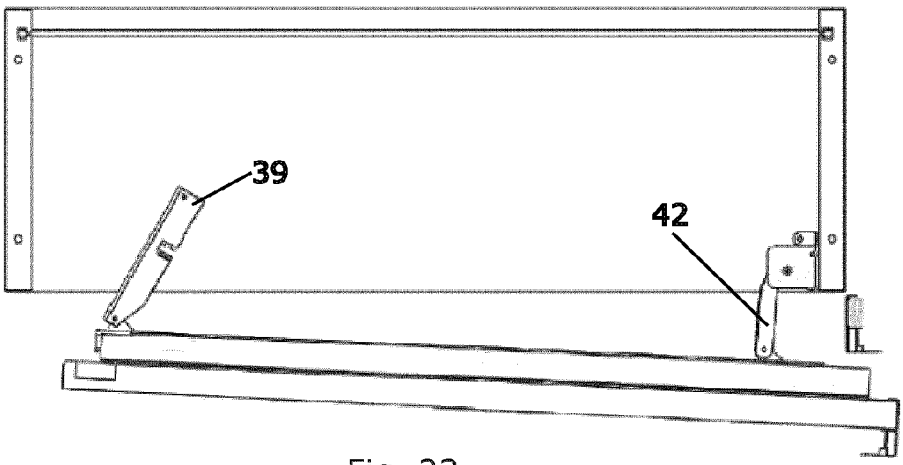
Figure 24:
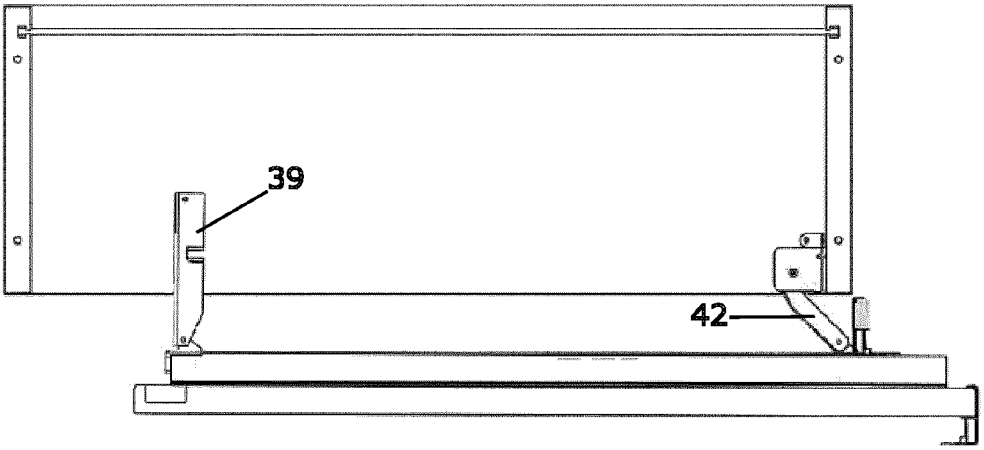
Figure 25:
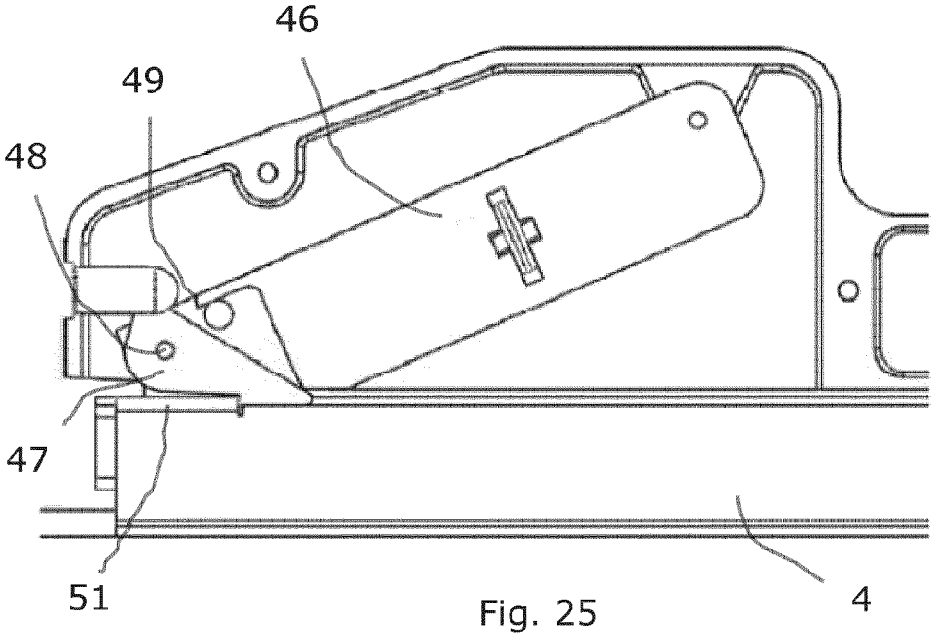
FIGS. 25 to 28 illustrate in sequence a second embodiment of a lock-and-release mechanism for a sliding door.
Figure 26:
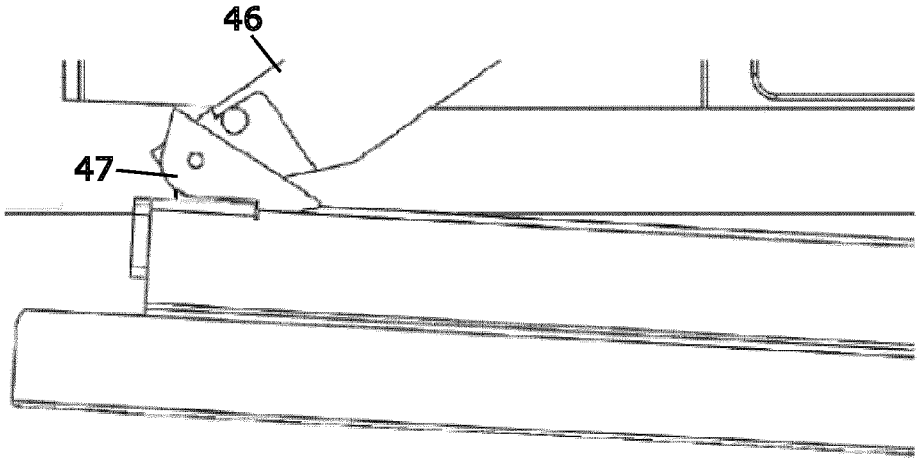
Figure 27:
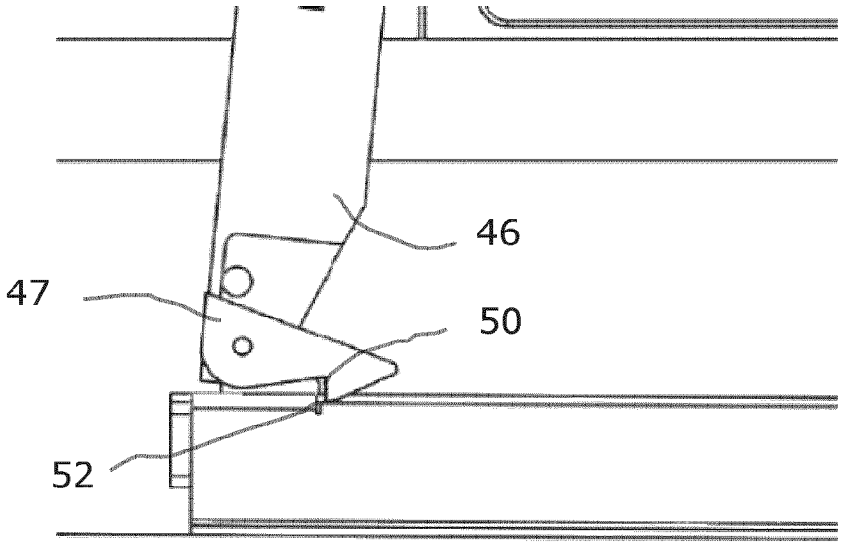
Figure 28:
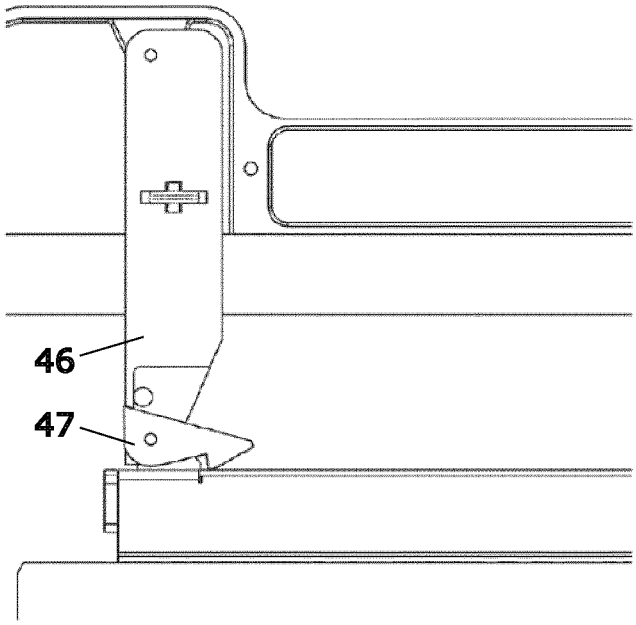

FIG. 15 illustrates the assembled mechanism mounted to a furniture frame and door, respectively, with a cover plate mounted.

Below further embodiments of mechanisms of the sliding door and further embodiments of the lock-and-release mechanism will be described with reference to the Figs., showing the different embodiments. Parts corresponding with parts of the other embodiments are given the same reference numbers and are normally not discussed extensively for each embodiment.

As stated above there is preferably one mechanism mounted at one end of an element, such as a sliding door, and an additional similar mechanism may be mounted at an opposite end of the element, such that the element can be given a stabile mounting and movement pattern below.

In the embodiment of FIGS. 16 to 20 the mechanism comprises a first lever arm 27 pivotally arranged between a first pivoting point 28 of the housing 2 and a second pivoting point 29 of the second member 6 of the pull-out guide rail 4. The mechanism further comprises a second lever arm 30 pivotally arranged with one end at a third pivoting point 31 of the second member 6 of the pull-out guide rail 4. The other end of the second lever arm 30 is arranged displaceable along a groove 32 of the housing 2. A third lever arm 33 is pivotally arranged between a fourth pivoting point 34 on the second lever arm 30 and a fifth pivoting point 35 in the housing 2. The second pivoting point 29 of the second member 6 of the pull-out guide rail 4 and the first lever arm 27 is placed at one end of said second member 6. The third pivoting point 31 of the second member 6 of the pull-out guide rail 2 and the second lever arm 30 is placed at a short distance from the other end of said second member 6. The groove 32 of the housing 2 receiving one end of the second lever arm 30, has a first part 36 inclining forward from a inner position of the housing 2 and towards an end of the housing 2 at which the third lever arm 33 is placed. Said end of the housing 2, is the end at which one end of the sliding door 1 is given a first movement outwards. The first inclined part 36 of the groove 32 is followed by a second part 37 having a general extension perpendicular to the sliding door. Said second part 37 of the groove 32 has a slightly bent form, whereby the end of the groove 32 is placed closer to the end of the housing 2 at which the third lever arm 33 is placed, than the area of the groove 32 going over from the first part 36 to the second part 37. The second lever arm 30 is displaceable along the groove 32 by means of a guiding wheel 38. The second lever arm 30 has a bent form and the fifth pivoting point 35 is placed on the inside of the bend of the second lever arm 30.

In opening of the sliding door 1 of this embodiment, one end of the sliding door 1 is pulled outwards, whereby the guiding wheel 38 of the second lever arm 30 will go along the first part 36 of the groove 32. The third lever arm 33 will be pivoted outwards as the second lever arm 30 goes along the groove 32. When the guide wheel 38 of the second lever arm 30 has reached the area where the groove 32 goes over from the first part 36 to the second part 37, the first lever arm 27 will start to turn outwards. The first lever arm 27 will turn until it is approximately perpendicular to the sliding door 1. When the first lever arm 27 has been turned outwards to the position perpendicular to the sliding door 1, the guide wheel 38 of the second lever arm 30 has reached the end of the second part 37 of the groove 32. The third lever arm 33 will turn outward until it is perpendicular to the sliding door 1. In the position where both the first lever arm 27 and the third lever arm 33 are perpendicular to the sliding door 1, the sliding door 1 will be slid open.

In the embodiment of FIGS. 21 to 24 the mechanism comprises a first lever arm 39 pivotally arranged between a first pivoting point 40 of the housing 2 and a second pivoting point 41 of the second member 6 of the pull-out guide rail 4. The mechanism further comprises a second lever arm 42 pivotally arranged between a third pivoting point 43 of the second member 6 of the pull-out guide rail 4 and a fourth pivoting point 44 of the housing 2. The second pivoting point 41 of the second member 6 of the pull-out guide rail 4 and the first lever arm 39 is placed at one end of said second member 6. The third pivoting point 43 of the second member 6 of the pull-out guide rail 2 and the second lever arm 42 is placed at a distance from the other end of said second member 6. The second lever arm 42 have a bent form whereby the lower part of the second lever arm 42 will be directed forward in the open position.

Common for all embodiments is that the pivoting point between one lever arm and the pull-out guide is placed at one end of the pull-out guide, while the pivoting point of one lever arm is placed a distance from the other end of the pull-out guide.

In FIGS. 25 to 28 a further embodiment for a lock-and-release mechanism is shown. A lever arm 46 will act on a locking arm 47 to release the sliding door 1 for a sliding movement. The locking arm 47 is turned around a pivoting point 48 by means of the lever arm 46. The locking arm 47 is spring loaded towards a locking position. The lever arm 46 has an edge 49 placed at a distance from the locking arm 47 in the closed position. The locking arm 47 has a detent 50 at one end, which detent abuts an edge 52 of an extension 51 of a member of the pull-out guide rail 4 in the closed position. The edge 49 of the lever arm 46 will act on the locking arm 47 at the end of the locking arm 47 opposite the end having the detent 50, in relation to the pivoting point 48. Thereby, the detent 50 of the locking arm 47 will be lifted free from the edge 52 of the extension 51 of a member of the pull-out guide rail 4 when the locking arm 47 is turned by the movement of the lever arm 46. The turning movement of the locking arm 47, activated by the edge 49 of the lever arm 46, is acting against the spring load of the locking arm 47. The detent 50 is lifted free of the edge 52 in the open position of the opening and closing mechanism for the sliding door.

Figure 29:
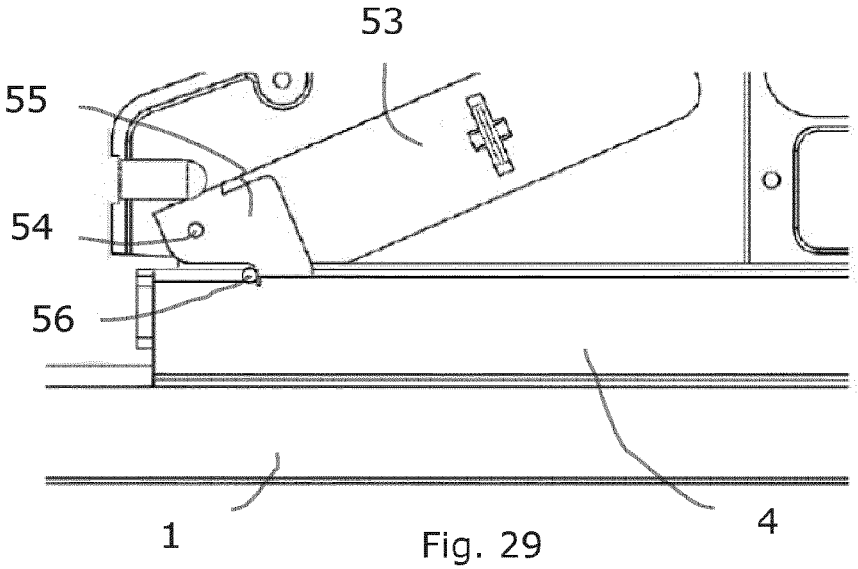
FIGS. 29 to 31 illustrate in sequence a third embodiment of a lock-and-release mechanism for a sliding door.
Figure 30:
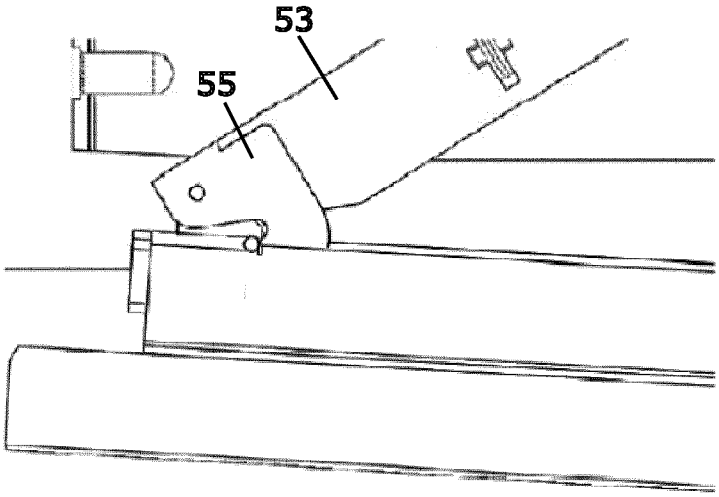
Figure 31:
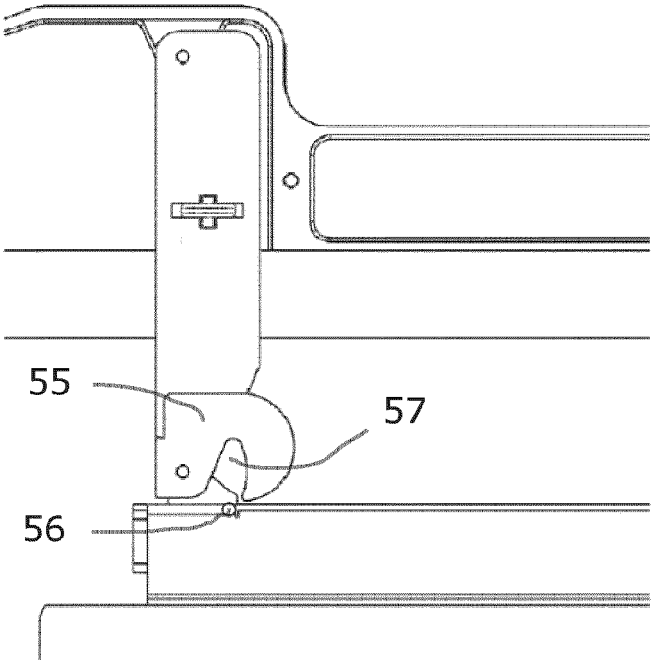
Figure 32:
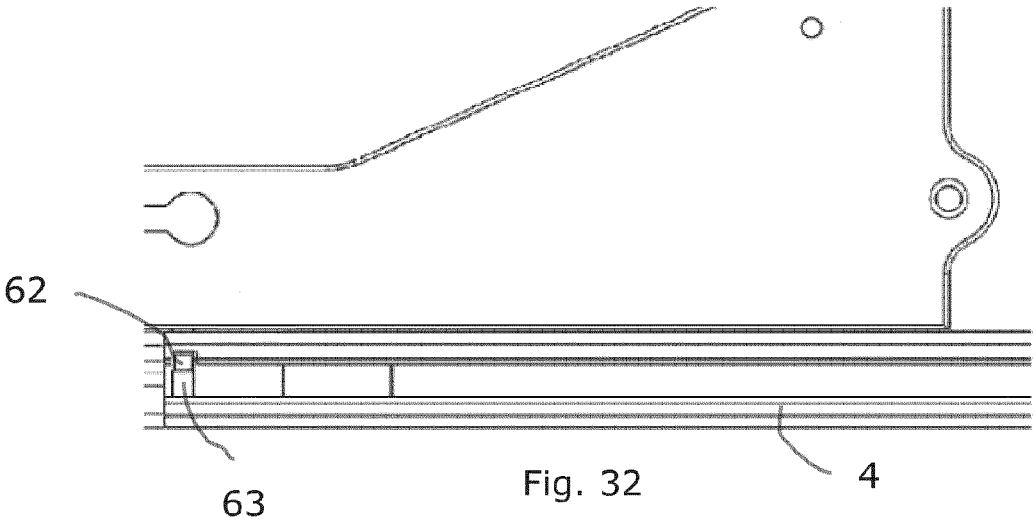
FIGS. 32 to 35 illustrate in sequence a fourth embodiment of a lock-and-release mechanism for a sliding door.
Figure 33:
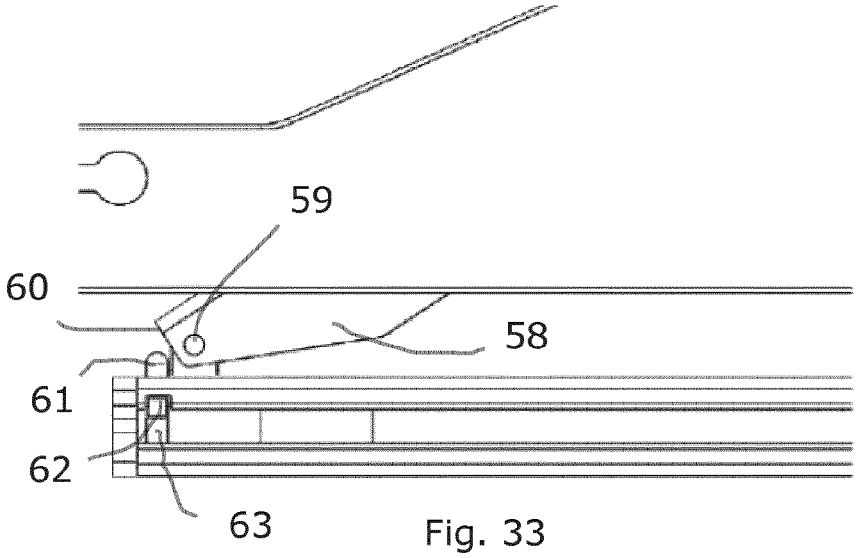
Figure 34:
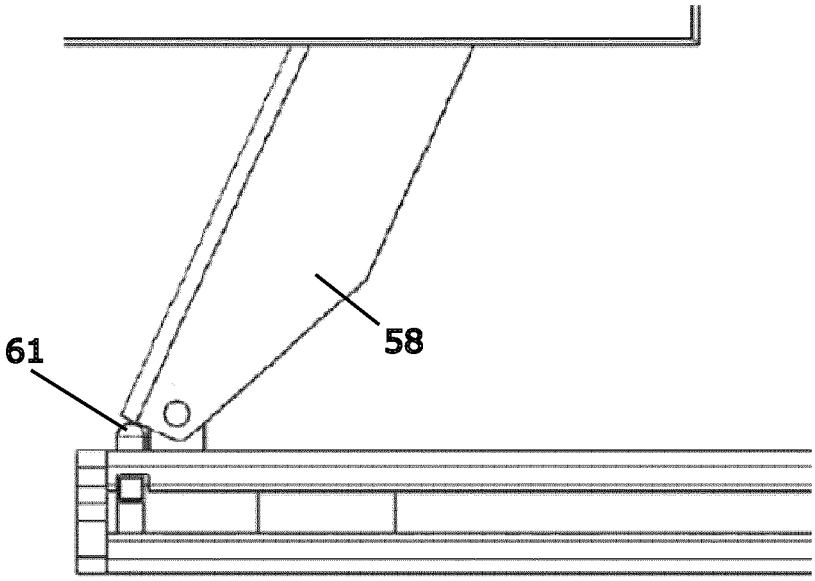
Figure 35:
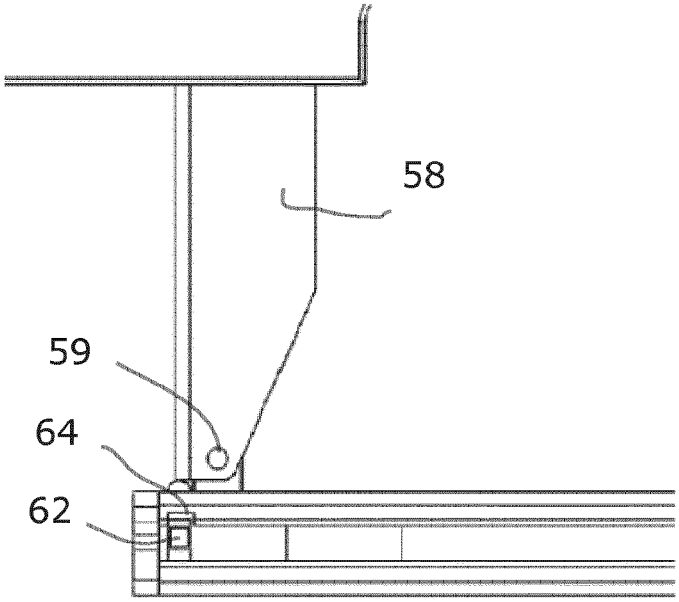

In the FIGS. 29 to 31 a further embodiment of a lock-and-release mechanism is shown. A lever arm 53 is received in a pivoting point 54 of the pull-out guide rail 4. An end part 55 of the lever arm 53 has a groove 57 to receive a pin 56, placed at a member of the pull-out guide rail 4. The end part 55 is an integrated part of the lever arm 53 or a separate part fixed to the lever arm 53. During the opening movement the lever arm 53 will turn in the pivoting point 54, whereby the end part 55 is also turned and there will be a relative movement between the pin 56 and the groove 57 of the end part 55 of the lever arm 53. The form of the groove 57 is such that the pin 56 will be free from the groove 57 in the open position of the opening and closing mechanism for the sliding door 1. Thus, in said open position the sliding door 1 may be slid open.

In the FIGS. 32 to 35 still a further embodiment of a lock-and-release mechanism is shown. A lever arm 58 is received in a pivoting point 59 of the pull-out guide rail 4. An end part 60 of the lever arm 58 will act on one end of a locking pin 61. The locking pin 61 has a projecting part 62 at the end opposite the end of the locking pin 61 acted on by the lever arm 58. The locking pin 61 is pressed towards the lever arm 58 by means of a spring. The locking pin 61 may be moved in a guide groove 63 on the pull-out guide rail 4. The locking pin 61 has a projecting part 62 at the end' opposite the end acted on by the lever arm 58. In the closed position the projecting part 62 of the locking pin 61 is received in a recess 64 at the guide groove 63 of the pull-out guide rail 4. When the projecting part 62 of the locking pin 61 is received in the recess of the guide groove 63, two members of the pull-out guide rail 4 are hindered from moving relative each other. During the opening movement the lever arm 58 will turn around the pivoting point 59. The end part 60 of the lever arm 58 will then move towards the locking pin 61. When the end part 60 of the lever arm 58 starts to press on the locking pin 61, the projecting part 62 of the locking pin 61 will be displaced in direction away from the recess 64. In the open position the projecting part 62 has left the recess, whereby the two members of the pull-out guide rail 4 may be displaced relative each other, whereby the sliding door 1 may be slid to an open position.

The different embodiments of the lock-and-release mechanism may be used with any of the different embodiments of opening and closing mechanism for the sliding door.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A mechanism for moving a door from a first location to a second location, which movement includes a sliding movement, whereby the mechanism comprises;

a housing;

a pull-out guide rail having a first member mounted to the door, wherein the first member and a second member are arranged slidably in relation to each other;

a first lever arm, one end of which is connected to a first pivoting point at the pull-out guide rail and an opposite end of said first lever arm being connected to a second pivoting point at the housing of the mechanism, wherein the first pivoting point at the pull-out guide rail is placed at a first end of the pull-out guide rail; and a second lever arm, wherein a first end of said second lever arm is connected to a third pivoting point on the pull-out guide rail, wherein a second end of the second lever arm is received in a groove of the housing by means of a guiding means, and wherein a first end of a third lever arm is connected to a fourth pivoting point in the second lever arm and a second end of the third lever arm is connected to a fifth pivoting point in the housing, wherein the groove of the housing has a first part entirely inclining forward from an inner position of the housing and towards an end of the housing in which the fifth pivot point is placed and wherein the groove of the housing has a second part generally extending perpendicular to the door, whereby said second part of the groove has a slightly bent form towards the end of the housing at which the third lever arm is placed, wherein the guiding means slides towards the pull-out guide rail when traveling from the first part towards the second part.

2. The mechanism of claim 1, wherein said third pivoting point at the pull-out guide rail is placed at a distance from a second end of the pull-out guide rail opposite the first end of the pull-out guide rail.

* * * * *